US007614377B2

(12) United States Patent
Noguchi

(10) Patent No.: US 7,614,377 B2
(45) Date of Patent: Nov. 10, 2009

(54) ENGINE CONTROL APPARATUS

(75) Inventor: Takuro Noguchi, Hyogo (JP)

(73) Assignee: Mitsubishi Electric Corporation, Tokyo (JP)

( * ) Notice: Subject to any disclaimer, the term of this patent is extended or adjusted under 35 U.S.C. 154(b) by 261 days.

(21) Appl. No.: 11/798,064

(22) Filed: May 10, 2007

(65) Prior Publication Data

US 2008/0115753 A1 May 22, 2008

(30) Foreign Application Priority Data

Nov. 22, 2006 (JP) ..... 2006-315728

(51) Int. Cl.
*F02N 11/10* (2006.01)
*H01H 50/00* (2006.01)
*H01H 7/00* (2006.01)

(52) U.S. Cl. ..... 123/179.3; 361/33

(58) Field of Classification Search ..... 123/179; 307/10.6; 361/33
See application file for complete search history.

(56) References Cited

U.S. PATENT DOCUMENTS 3,681,658 A * 8/1972 Naoi et al. ..... 361/33
3,857,043 A * 12/1974 Habasch ..... 290/38 R
3,885,543 A * 5/1975 Swartz ..... 123/179.3
4,104,688 A * 8/1978 Pecsi ..... 361/28
4,570,583 A * 2/1986 Hamano et al. ..... 477/99
4,622,930 A * 11/1986 Hamano et al. ..... 477/99
5,742,137 A * 4/1998 Bratton et al. ..... 318/139
5,936,316 A * 8/1999 Jurkiewicz et al. ..... 307/10.6
5,970,938 A * 10/1999 Hisamoto et al. ..... 123/179.3
6,024,065 A * 2/2000 Hojna et al. ..... 123/179.3
6,481,404 B1 * 11/2002 Perry et al. ..... 123/179.3
6,497,209 B1 * 12/2002 Karuppana et al. ..... 123/179.3
6,789,520 B2 * 9/2004 Saito ..... 123/179.3
7,107,957 B2 * 9/2006 Denz et al. ..... 123/179.3
2008/0092841 A1 * 4/2008 Takahashi ..... 123/179.16

FOREIGN PATENT DOCUMENTS

JP 53-37838 4/1978
JP 10-318106 A 12/1998

* cited by examiner

*Primary Examiner*—Stephen K Cronin
*Assistant Examiner*—Arnold Castro
(74) *Attorney, Agent, or Firm*—Sughrue Mion, PLLC

(57) ABSTRACT

An engine control apparatus in which, when it is detected by a starter switch that a starter has changed-over from a drive state into a non-drive state, an ECU (engine control unit) predicts a time period in which an engine is completely stopped, on the basis of a revolution speed of the engine at that time, so as to turn OFF an output of a starting motor relay for the predicted period.

6 Claims, 3 Drawing Sheets

SETTING EXAMPLE OF PREDICTION TIME FOR ENGINE COMPLETE STOP

| ENGINE REVOLUTION SPEED [r/m] | ENGINE COMPLETE STOP TIME ms |
|---|---|
| 50 | 100 |
| 100 | 120 |
| 150 | 180 |
| 200 | 200 |
| 250 | 220 |
| 300 | 240 |
| 350 | 320 |
| 400 | 360 |
| 450 | 400 |
| 500 | 500 |
| 550 | 600 |

ENGINE CONTROL APPARATUS

BACKGROUND OF THE INVENTION

1. Field of the Invention

This invention relates to an engine control apparatus wherein a cylinder discrimination control is performed on the basis of, for example, the crankangle signals of the crankshaft and the cam signals of the camshaft of an engine. More particularly, it relates to an engine control apparatus which prevents the stop of cranking at the time of start and any erroneous cylinder discrimination at restart, thereby to reliably restart an engine, and which protects a starter starting motor (starter).

2. Description of the Related Art

In general, in a vehicular engine, there has been known an engine control apparatus wherein, in order to optimally control fuel injections and ignition timings for a plurality of cylinders in correspondence with running conditions, individual sensors for generating the crankangle signals and cam signals of the engine are disposed, and the cylinders are discriminated, and a fuel injection control and an ignition timing control are performed, on the basis of the outputs of the sensors. Besides, in recent years, the engine control apparatus has come to adopt the larger number of teeth of a crankangle signal plate for the calculation of the crankangle of the engine in order to perform a faster and more delicate fuel control as well as ignition control. A cylinder discrimination control has become a higher degree and more complicated, and a very large number of control development manhour has been expended on a control development concerning the cylinder discrimination.

In starting the engine, a starting motor (hereinbelow, also termed "starter") for driving the engine as uses a battery as a power source is employed in order to bring the engine into a complete explosion.

The starter consists of a pinion which meshes with a ring gear fixed to a crankshaft, and a motor portion which feeds a rotating force to the pinion. Incidentally, a starting motor relay for ON/OFF-controlling power feed to the motor is disposed.

During cranking at the engine start, the starter is driven, whereby the engine starts rotating, and an engine control unit (hereinbelow, also termed "ECU") performs the cylinder discrimination. In this regard, the driver of a vehicle erroneously turns OFF a starter switch rarely. Further, at low temperatures, it is sometimes the case that a reliable combustion is not attained, and that the so-called "complete explosion" is not reached even when the starter is driven for a while, so the engine stops due to starter-OFF.

More specifically, when a piston fails to ascend to a compression top dead center due to the starter-OFF during a compression stroke, it descends immediately before the top dead center, and the engine causes a reverse rotation and then stops.

Further, on this occasion, in a case where the driver has tried restart during the engine reverse rotation or immediately before the engine stop, the cycles of the crankangle sensor signals become unequal intervals at the start of the engine rotation based on the starter drive at the time of the restart. In some cases, accordingly, the engine control unit cannot properly discriminate the cylinders, and the ignition control and the fuel injection control cannot be performed for the appropriate cylinders, so that a restartability worsens.

Moreover, the inferior meshing of the pinion sometimes occurs on account of an engine forward rotation and the engine reverse rotation based on the starter drive or the jump of the pinion into the ring gear being rotating.

In view of such drawbacks, JP-UM-A-53-37838 (hereinbelow, termed "Patent Document 1") has proposed in a circuit wherein a starter is operated by a starter switch, a starter protection apparatus in which once the starter switch has been opened, the starter is prevented from operating for a certain fixed time period.

Besides, JP-A-10-318106 (hereinbelow, termed "Patent Document 2") has proposed a starter protection apparatus in which the operation of a starting motor is continued during the actuation of a starter switch, whereby an engine is reliably started, and in which the operation of the starting motor is suppressed even when the starter switch is actuated during the rotation of the engine or immediately after the stop of the engine, whereby a starter pinion is prevented from jumping into a ring gear being rotating.

As described above, in the prior-art apparatus, in the case where the "ON" and "OFF" of the starter attributed to any of various engine starting environments or the actuation of the starter switch have been repeated during the cranking at the start of the engine, the cycles of the crankangle sensor signals become the unequal intervals, and hence, the cylinders are not discriminated properly. As a result, the fuel injection control and the ignition timing control become different from desired ones, and the restartability worsens. In the worst case, a backfire and a starter lock might be incurred.

Besides, when the starter is driven again, the starter pinion jumps into the ring gear being rotating due to the engine forward rotation or the engine reverse rotation, whereby the starter pinion undergoes a large load in meshing with the ring gear, and the damage of the gear or the starter lock occurs. In the worst case, a situation where the restart is impossible can occur.

Further, in the starter protection apparatus stated in each of Patent Documents 1 and 2, once the starter switch has been opened, the starter cannot be driven for the certain fixed time period. Therefore, in a case where the engine could not be started by the preceding actuation of the starter switch, it cannot be restarted till the lapse of the fixed time period, even if it is in a completely stopped state. That is, however high an engine revolution speed at the time of the failure of the first start may be, the fixed time period needs to be waited. This leads to the problem that, since the starter does not rotate at the restart, an uneasy feeling is inflicted on the driver.

SUMMARY OF THE INVENTION

This invention has been made in order to eliminate the problems of the prior-art apparatuses as stated above, and it consists in an engine control apparatus including an engine control unit which has the function of driving and controlling a starting motor relay that can inhibit power feed to a starting motor for a predetermined time period since the turn-OFF of a starter switch, even when the starter switch has turned ON, characterized in that the drive inhibition time period of the starting motor relay is altered in correspondence with the revolution speed of an engine at the time when the starter switch has changed from "ON" to "OFF". More specifically, it is an object of this invention to provide an engine control apparatus in which, when the engine revolution speed is low at the change of the starter switch from the "ON" to the "OFF", a restart allowance is quickened, thereby to shorten the re-drive inhibition period of a starter, so that an uneasy feeling is not inflicted on the driver of a vehicle, whereas when the engine revolution speed is high at the change of the starter switch from the "ON" to the "OFF", the re-drive inhibition period of the starter is set to be long, whereby a starter pinion is prevented from jumping into a ring gear under rotation, so that the starting motor (the starter) can be protected.

A further object is to provide an engine control apparatus which can be realized only by the addition of the software processing of an engine control unit, and which is accordingly meritorious in cost.

An engine control apparatus according to this invention includes a starter switch which is turned ON in starting an engine, a starting motor which has a pinion meshing with a ring gear of the engine and which is driven in starting the engine, a crankangle sensor which outputs a crankangle signal every predetermined rotational angle of a crankshaft, a cam sensor which outputs a signal in a predetermined pattern for performing a cylinder discrimination in correspondence with rotation of a camshaft that rotates at a predetermined rate to rotation of the crankshaft, and an engine control unit which has a function of performing an ignition control and a fuel control of the engine on the basis of, at least, the output signals of the crankangle sensor and the cam sensor, and a function of driving and controlling the starting motor on the basis of an input signal of the starter switch. Here, the engine control unit includes restart inhibition means for inhibiting power feed to the starting motor for a predetermined time period since change of the starter switch from "ON" to "OFF", even when the starter switch turns ON again, and means for altering the predetermined time period in correspondence with a revolution speed of the engine at the change of the starter switch from the "ON" to the "OFF".

According to the engine control apparatus of this invention, when it is detected that a starter has changed-over from its drive state into its non-drive state, a time period in which the engine (crank) is completely stopped is predicted on the basis of an engine revolution speed at that time, and a predetermined period corresponding to the revolution speed is set as the restart inhibition period. Therefore, the engine can be restarted from a state where it has stopped, and it is possible to prevent that worsening of a restartability which occurs at the time of the restart during rotation immediately before the engine stop, and in which the cycles of the crankangle sensor signals become unequal intervals, so the engine control unit cannot properly perform the cylinder discrimination and fails to perform the ignition control and fuel injection control for the appropriate cylinders. Moreover, the restart inhibition time is shortened to the utmost, whereby the engine can be started reasonably and reliably without inflicting an uneasy feeling on the driver of a vehicle, to bring forth the advantage that the restartability is enhanced.

Besides, the starter pinion is prevented from jumping into the ring gear under rotation, whereby the starting motor (the starter) can be protected.

The foregoing and other objects, features, aspects and advantages of this invention will become more apparent from the following detailed description of this invention when taken in conjunction with the accompanying drawings.

DESCRIPTION OF THE PREFERRED EMBODIMENT

Now, one embodiment of this invention will be described with reference to FIGS. 1 through 3.

Figure 1:
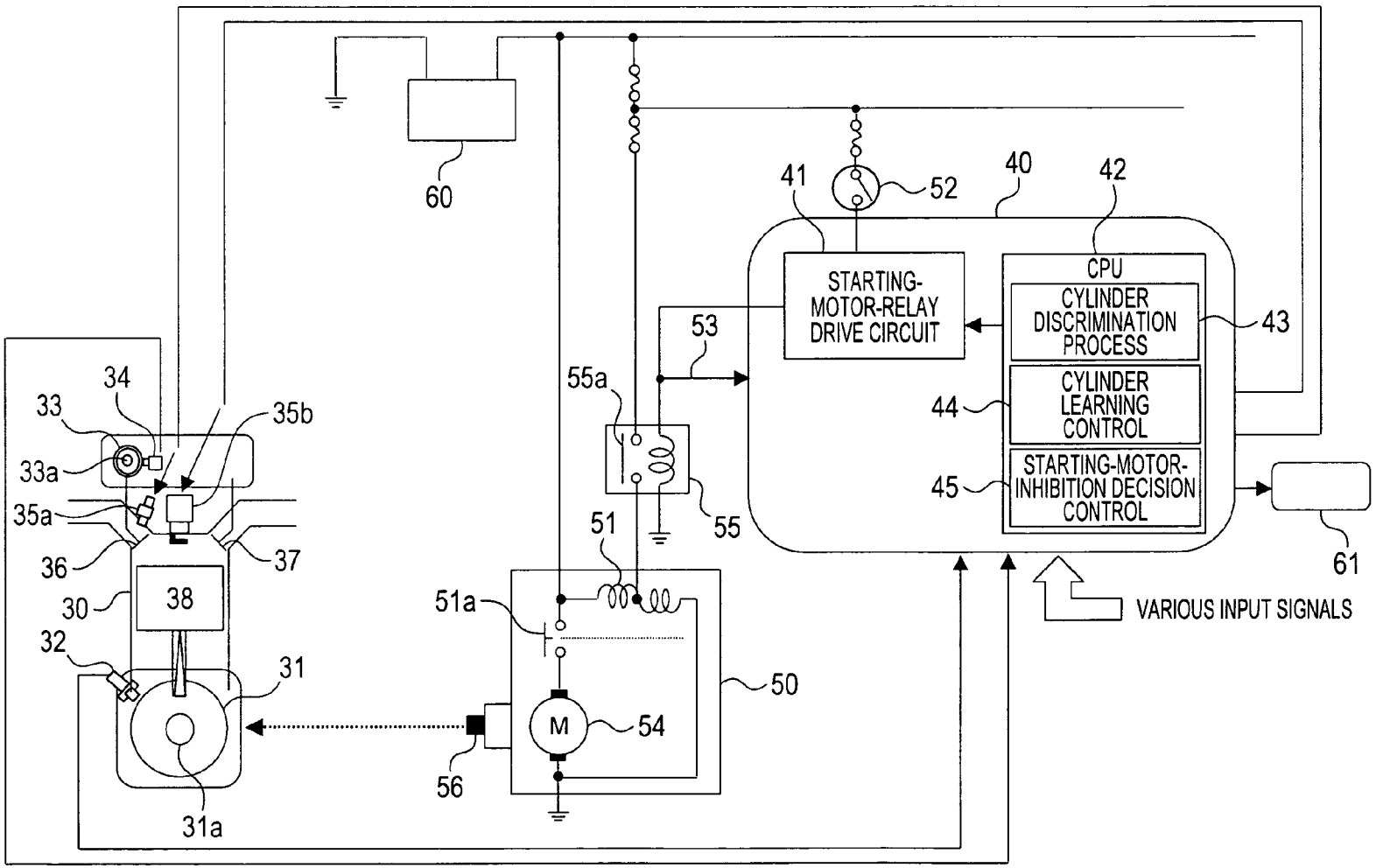
FIG. 1 is a system arrangement diagram showing the essential portions of an engine control apparatus in an embodiment of this invention.
Figure 2:
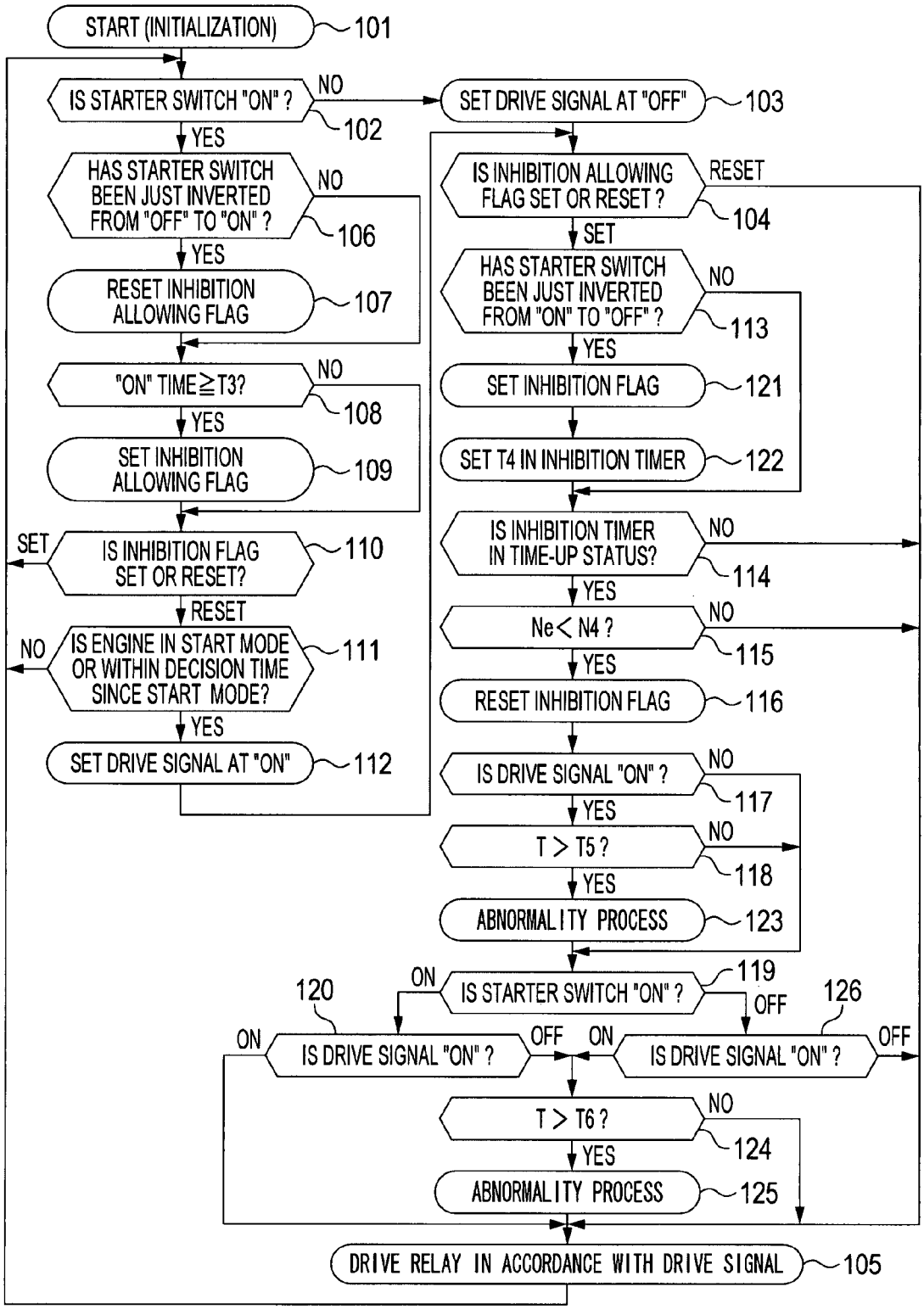
FIG. 2 is a basic flow chart of a starter control system in the embodiment of this invention.

FIG. 1 is a system arrangement diagram showing the essential portions of an engine control apparatus according to the embodiment of this invention.

Referring to FIG. 1, an engine proper 30 includes a fuel injection valve (hereinbelow, also termed "injector") 35*a*, an ignition plug 35*b*, a suction valve 36, an exhaust valve 37, a piston 38, a crankshaft 31*a*, a crankangle detecting signal plate 31 which rotates in synchronism with the crankshaft 31*a*, a crankangle sensor 32 which outputs a crankangle signal every predetermined angle, a camshaft 33*a* which rotates at a predetermined rate to the rotation of the crankshaft 31*a*, a cam signal plate 33 which rotates in synchronism with the camshaft 33*a*, and a cam sensor 34 which outputs a predetermined pattern signal in order to perform a cylinder discrimination. Incidentally, a ring gear is fixed to the crankshaft 31*a* though not clearly shown in the figure, and the engine is a multicylinder engine.

A starter 50 has the plus terminal of an on-vehicle battery 60 connected thereto. The starter 50 is configured of a pinion 56 which meshes with the ring gear fixed to the crankshaft 31*a*, a starting motor 54 which serves to feed a rotating force to the pinion 56, and a magnetic switch relay 51 which activates the starting motor 54. Besides, a starting motor relay 55 which feeds and cuts off a DC supply voltage from the on-vehicle battery 60 to the exciting coil of the magnetic switch relay 51 is disposed outside the starter 50.

An engine control unit (hereinbelow, also termed "ECU") 40 is configured so as to receive the output signals of an accelerator position sensor, a suction air quantity sensor, a suction air temperature sensor, a throttle position sensor, an air conditioner switch, a shift position switch, a vehicle velocity sensor, a power steering switch which detects a power steering operation state, a water temperature sensor which detects the temperature of engine cooling water, an atmospheric pressure sensor which detects the pressure of the atmosphere, an oxygen sensor which detects an oxygen concentration in exhaust gas, and so forth. Further, the ECU 40 calculates a fuel injection quantity and a fuel injection timing as well as an ignition timing which are optimal to a present-time engine running state, on the basis of the output signals from the crankangle sensor 32 and cam sensor 34 and the input information (various parameters) of the above sensors and switches, so as to drive the injector 35*a* and the ignition plug 35*b*.

The ECU 40 discriminates a starting fuel injection cylinder and an ignition cylinder by a cylinder discrimination process portion 43 on the basis of the signals of the crankangle sensor 32 and the cam sensor 34. Further, the ECU 40 calculates the optimal fuel injection quantity and ignition timing on the basis of these signals in addition to the above sensor signals, so as to drive the injector 35*a* and the ignition plug 35*b*.

Besides, in a case where the cylinder discrimination has been once made by the cylinder discrimination process portion 43 at the start of the engine, a cylinder learning control portion 44 learns and stores the sequence of the cylinder discrimination. Thenceforth, the fuel injection cylinder and the ignition control cylinder are discriminated every so-called "combustion cycle" of the engine in synchronism with that signal of the crankangle sensor 32 (which may well be replaced with the specified signal of the cam sensor 34), on the basis of the learnt sequence, whereupon the cylinder discrimination control based on the learning is continued. The learning control by the cylinder learning control portion 44 is continued until an engine stall mode to be explained later is decided on account of the stop of the engine.

The ECU 40 is provided with a starting-motor-relay drive circuit 41 which ON/OFF-controls power feed to the exciting coil of the starting motor relay 55. Further, the ON/OFF signal of a starter switch 52 is inputted to the drive circuit 41.

Besides, the arithmetic process portion (hereinbelow, termed "CPU") 42 of the ECU 40 includes a starting-motor-inhibition decision control portion 45, which has the function of turning ON/OFF the magnetic switch relay 51 through the starting-motor-relay drive circuit 41 and the starting motor relay 55. Further, as will be explained later, the ECU 40 is so configured that, even in a case where the starter switch 52 is "ON", the starting motor relay 55 can be forcibly turned OFF, thereby to stop the power feed to the starting motor 54. This is used in common with a device which is included din, for example, a general antitheft system in order that the engine may be prevented from starting in such a case where an illegal key is used and where a start inhibition has been decided.

Incidentally, numeral 61 designates an alarm lamp which is driven by the ECU 40 and which presents an alarm display at any abnormality of the starter 50.

Here, before the description of the operation of the embodiment, a general ordinary engine start will be described with reference to FIG. 1.

When the starter switch 52 is turned ON, the ECU 40 turns ON a contact 55*a* in such a way that, when the drivable condition of the starting motor relay 55 holds, an exciting current is caused to flow through the exciting coil of the starting motor relay 55 by the starting-motor-relay drive circuit 41. When the contact 55*a* of the starting motor relay 55 is turned ON, an exciting current flows through the exciting coil of the magnetic switch relay 51 of the starter 50, and the contact 51*a* of the magnetic switch relay 51 is turned ON. Then, the DC supply voltage of the on-vehicle battery 60 is fed to the starting motor 54, so that the starting motor 54 is activated. When the starting motor 54 is activated, the pinion 56 jumps into and meshes with the ring gear fixed to the crankshaft 31*a*, and it transmits the rotating power of the starting motor 54 to the crankshaft 31*a* so as to rotate this crankshaft 31*a*.

When the crankshaft 31*a* is rotated, the crankangle detecting signal plate 31 is rotated in synchronism with the crankshaft 31*a*, and the crankangle sensor 32 generates the crankangle signal every predetermined angle. Besides, the cam signal plate 33 is rotated in synchronism with the camshaft 33*a* which is rotated at the predetermined rate to the rotation of the crankshaft 31*a*, whereby the cam sensor 34 outputs a predetermined pattern signal for performing the cylinder discrimination.

The ECU 40 executes the cylinder discrimination process in the cylinder discrimination process portion 43 on the basis of the signal inputs from the crankangle sensor 32 and the cam sensor 34, and it performs the fuel injection control and the ignition timing control required for the engine start, whereby the start of the engine, or so-called "complete explosion" is attained. Thenceforth, the ECU 40 performs the fuel injection control, ignition timing control, suction air quantity control, etc. which are optimal to the present-time engine running state, on the basis of the input information (various parameters) from the various sensors and switches, whereby the rotation of the engine is held.

Next, the case of an irregular start (start failure) where the driver erroneously turns OFF the starter switch 52 during the start of the engine (before the completion of the start) will be described with reference to FIG. 1.

When the starter switch 52 is turned OFF amidst the engine start, the ECU 40 stops the current feed to the starting motor relay 55, on the basis of the OFF signal of the starter switch 52, whereby the exciting current to the exciting coil of the starting motor relay 55 is cut off to turn OFF the contact 55*a*. When the contact 55*a* of the starting motor relay 55 is turned OFF, the exciting current to the exciting coil of the magnetic switch relay 51 of the starter 50 is also cut off to stop the power feed to the starting motor 54, and the starter pinion 56 is disengaged from the ring gear.

On this occasion, the starting motor 54 continues to rotate until an inertial action becomes null.

In the engine 30, the ring gear fixed to the crankshaft 31*a* similarly continues to rotate until an inertial action becomes null, in a case where the so-called "complete explosion" has not been attained. When an inertial force lowers, the piston 38 fails to ascend to a compression top dead center, and the crank rotation stops. Sometimes, however, the piston 38 descends immediately before the compression top dead center on account of its weight, and the engine gives rise to the reverse rotation. Here, since the rotation is reversed from the forward rotation, it stops for a moment.

In this manner, the reverse rotation is sometimes involved immediately before the stop of the engine (crank). Here, the cycles of the signals of the crankangle sensor 32 and the cam sensor 34 become unequal intervals (not corresponding to the cylinder sequence) because the signals corresponding to the identical cylinder are continuously generated due to the reversal.

When the driver turns ON the starter switch 52 again during such an engine rotation before the stop of the engine, a maldecision in the cylinder discrimination process or the inferior meshing between the ring gear and the starter pinion occurs as stated above.

The engine control apparatus of the embodiment of this invention has functions for eliminating such disadvantages of the prior-art apparatus, in the ECU 40. Now, the operation and functions of the embodiment will be described with reference to the system arrangement diagram of FIG. 1 and the flow chart of FIG. 2.

When the ECU 40 is fed with a supply voltage from the on-vehicle battery 60, the CPU 42 mounted in the ECU 40 is activated, and it starts processing in accordance with a program written therein.

First, upon the closure of the power supply, various flags etc. to be stated later are initialized at a step 101. The drive signal 53 of the starter 50 is set at "OFF", an inhibition flag is reset, an inhibition allowing flag is reset, and various timers are initialized into time-up statuses.

Subsequently, at a step 102, whether or not the starter switch 52 is "ON" is decided. If the starter switch 52 is not "ON", the drive signal 53 of the starter 50 is set at "OFF" at a step 103, and the routine proceeds to a step 104. On this occasion, the inhibition allowing flag has been reset by the initialization, and the routine proceeds to the next step 105. Since the drive signal 53 of the starter 50 is "OFF" at this time, the starting-motor-relay drive circuit 41 turns OFF the starting motor relay 55 by the OFF signal, and hence, the power feed to the starting motor 54 is stopped.

Subsequently, the routine returns to the step 102, and this state is continued until the starter switch 52 is turned ON.

When the driver turns ON the starter switch 52 from this state, if the starter switch 52 is "ON" is decided at the step 102, and whether or not the starter switch 52 has been just inverted from "OFF" to "ON" is decided at the next step 106. If the decision is "YES", the inhibition allowing flag is reset at a step 107, and the routine proceeds to a step 108.

Incidentally, during an "ON" period in the case where the starter switch 52 has been turned ON again after the inversion from "ON" to "OFF", the routine proceeds from the step 106 to the step 108 by bypassing the step 107.

At the step 108, whether or not the ON time of the starter switch 52 has continued for, at least, a predetermined time T3 is decided by a timer which is set at the timing of the inversion of the starter switch 52 from "OFF" to "ON" though not clearly shown in the figure. If the ON time has continued, the inhibition allowing flag is set at a step 109. Incidentally, when the ON time has not continued, the inhibition allowing flag remains reset.

Regarding the inhibition allowing flag, even when the starter switch 52 is turned ON for a short period, the starter 50 is not actually driven due to the operation delay of this starter 50. Therefore, the inhibition allowing flag serves to prevent the allowance of an inhibition control to be explained later, for inhibiting starter power feed irrespective of the "ON" of the starter switch 52, by the reset of this inhibition allowing flag. The predetermined time T3 is set in correspondence with electrical and mechanical delay times which are involved since the ON start of the starter switch 52 until the engine starts rotating owing to the rotation of the starting motor 54 through the starting motor relay 55.

At the next step 110, whether the inhibition flag is set or reset is checked. The inhibition flag in its set status inhibits the power feed to the starter 50 irrespective of the "ON" of the starter switch 52. Since the inhibition flag has been reset by the initialization, it is in its reset status at the first "ON" of the starter switch 52.

If the inhibition flag is in the reset status, the routine proceeds to a step 111, which checks whether or not the engine is in a start mode or within a predetermined time since the start mode. The start mode is released when the starter switch 52 has changed from "ON" to "OFF" or when an engine revolution speed calculated from the output signal of the crankangle sensor 32 has become higher than a predetermined value N1. That is, a state where the starter switch 52 is "ON" and where the revolution speed is, at most, the predetermined value N1 is the start mode. The predetermined value N1 is set at a value near the idling revolution speed of the engine. Therefore, even when the starting motor 54 is turned OFF at the time at which the engine revolution speed has become higher than the predetermined value N1, the engine does not require the rotating force of the starting motor 54, and it can be smoothly rotated by the combustion torque of the engine itself.

In the state where the engine is in the start mode or within the predetermined time T1 since the start mode, the drive signal 53 of the starter 50 is set at "ON" at a step 112.

On the other hand, subject to the judgment of the step 111 that the engine is neither in the start mode nor within the predetermined time T1 since the start mode, the routine returns to the step 102, and the drive of the starter 50 is inhibited without setting the starter drive signal 53 at "ON" irrespective of the "ON" of the starter switch 52.

More specifically, owing to the step 111, if the engine is in the start mode or within the predetermined time T1 since the release thereof, the starter drive signal 53 is set at "ON" in response to the "ON" of the starter switch 52 at the step 112 in order to reliably start the engine. Besides, in any other case, the start of the engine has been completed, and the engine is under an ordinary running. Therefore, the starting motor 54 is prevented from being driven even when the starter switch 52 is turned ON, and the starter pinion 56 is prevented from jumping into the ring gear under the engine rotation.

After the drive signal 53 of the starter 50 has been set at "ON" at the step 112, the routine proceeds to the step 104, at which the status of the inhibition allowing flag is checked. If the inhibition allowing flag is in the reset status (the "ON" of the starter switch 52 is shorter than the predetermined time T3), the starter 50 is driven in accordance with the "ON" of the drive signal 53 at the step 105.

Besides, if the inhibition allowing flag is set (the "ON" of the starter switch 52 has continued for, at least, the predetermined time T3) at the step 104, the routine proceeds to a step 113, which decides whether or not the starter switch 52 has been just inverted from "OFF" to "ON". Now that the starter switch 52 is in the "ON" state, the routine proceeds to a step 114. At the step 114, an inhibition timer to be explained later is in a time-up status owing to the initialization, so that the routine proceeds to a step 115. As this step 115 will also be explained later, it is followed by the step 105 if the engine revolution speed is, at least, equal to a predetermined low value N4 at which the substantial stop of the engine can be judged. The starter 50 is driven in accordance with the "ON" set of the drive signal 53 at this time.

Further, even when the engine revolution speed is lower than the predetermined value N4, the drive signal 53 is set at "ON" at this time, and hence, the routine proceeds to the step 105 through steps 116, 117, 118, 119 and 120 to be explained later. Thus, the starter 50 is driven in accordance with the "ON" set of the drive signal 53 at this time.

That is, at the first "ON" of the starter switch 52 after the closure of the power supply to the ECU 40, the drive signal 53 of the starter 50 is set at "ON" in synchronism with the first "ON", and the starter 50 is driven in synchronism with the first "ON".

Subsequently, when the driver turns OFF the starter switch 52 from the ON state thereof, this manipulation is decided at the step 102, and the drive signal 53 of the starter 50 is set at "OFF" at the step 103. If, at the next step 104, the ON time of the starter switch 52 is less than the predetermined value T3 to bring the inhibition allowing flag into the reset status as stated above, then the routine directly proceeds to the step 105, at which the drive of the starter 50 is stopped.

If the inhibition allowing flag is in the set status at the step 104, then the routine first proceeds to the step 113 in order that a process for inhibiting the power feed to the starter 50 for a predetermined time may be executed irrespective of the "ON" of the starter switch 52. At the step 113, whether or not the starter switch 52 has been just inverted from "ON" to "OFF" is decided. If the decision is "YES", the inhibition flag is set at a step 121, and an inhibition time T4 is set in an inhibition timer at a step 122.

In setting the inhibition time T4 for the inhibition timer, an engine revolution speed N2 calculated from a crankangle sensor signal, at the timing at which the starter switch 52 has changed from "ON" to "OFF" amidst the engine start, is first detected and stored on the basis of the signals from the starter switch 52 and the crankangle sensor 32. The CPU 42 has a memory map in which the engine-complete-stop prediction time T4 is previously stored with a parameter being the engine revolution speed N2. The time data T4 of the memory map is read out in correspondence with the revolution speed N2 detected on this occasion, and it is set in the inhibition timer.

The time data of the memory map will be described by taking FIG. 3 as an example.

Figure 3:
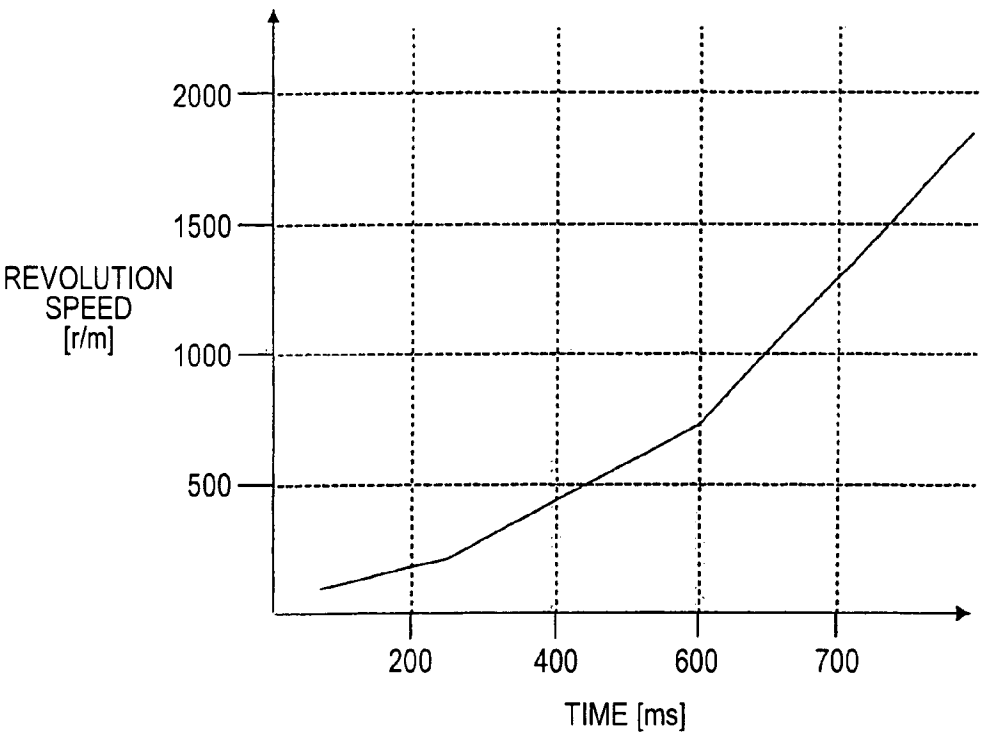
FIG. 3 is a characteristic diagram showing an example of the setting of the prediction time of an engine complete stop in the embodiment of this invention.

FIG. 3 exemplifies a characteristic diagram experimentally obtained, in which the engine revolution speed at the time when the starter switch 52 has changed from "ON" to "OFF", and a time period expended since this time until the engine (crank) rotation is completely stopped to afford the null crankangle sensor signal input are graphed.

In the case where the engine 30 shown in FIG. 1 has not reached the so-called "complete explosion" because the starter motor 54 turns OFF during the engine start before the completion thereof, the ring gear fixed to the crankshaft 31*a* continues to rotate until the inertial action becomes null. The inertial force lowers meantime, and the piston 38 stops, so that the engine stops. Alternatively, the piston 38 fails to ascend to the compression top dead center, and it descends immediately before the compression top dead center due to the weight thereof, so that the engine undergoes the reverse rotation and then stops. The time period expended till the engine stop is graphed. Accordingly, the setting example of the engine complete stop time as shown in FIG. 3 is stored as the controlling mapping data in the CPU 42 (FIG. 1) within the ECU 40 beforehand, whereby the predictive decision of the engine complete stop becomes possible.

Incidentally, on this occasion, in the case where the cycle of the signal input from the crankangle sensor 32 lengthens and where the engine revolution speed is lower than the predetermined speed N4 at which a signal change does not occur for a predetermined time and at which the engine rotation is substantially stopped, the engine ECU 40 decides this state as the engine stall mode.

In the case where the ECU 40 has decided the engine stall mode, it once initializes and clears the cylinder learning control in the cylinder learning control portion 44, in order that the cylinder discrimination based on the cam sensor output may be performed again at the next engine start. When the engine is restarted in the engine rotation state in which the learning of the cylinder discrimination is not cleared, the cycles of the crankangle sensor signals each of which occurs at the time of restart during the rotation immediately before the engine stop become unequal intervals which do not correspond to a cylinder sequence, and the ECU 40 cannot properly perform a cylinder discrimination based on a learning control and fails to perform an ignition timing control and a fuel injection control for appropriate cylinders, so that a restartability worsens.

In contrast, in the engine control apparatus of the embodiment, the restart inhibition time period is appropriately set, whereby the restart of the engine from the engine stop state is permitted, and the cylinder discrimination learning is reliably cleared, so that the cylinder discrimination can be accurately performed again on the basis of the crankangle sensor and the cam sensor. Besides, the restart inhibition time period is shortened to the utmost, whereby the engine can be started reasonably and reliably without inflicting an uneasy feeling on the driver, and the restartability can be enhanced.

Referring back to FIG. 2, whether or not the inhibition timer has timed up the predetermined time T4 is decided at the step 114. Before the predetermined time T4 lapses, the routine directly proceeds to the step 105, and the inhibition flag remains set for, at least, the predetermined time T4. Accordingly, even if the starter switch 52 turns ON meantime, the routine does not proceed to the "ON" set of the drive signal at the step 112, owing to the step 110, and the starter drive falls into the inhibited state.

When the inhibition timer has timed up at the step 114, whether or not the engine revolution number Ne is lower than the predetermined revolution number N4 is decided at the next step 115. If the engine revolution number Ne is lower than the predetermined revolution number N4, the inhibition flag is reset at the step 116. Subject to the reset status of the inhibition flag, when the starter switch 52 is turned ON, the drive signal 53 of the starter 50 can be set at "ON" by the step 112. On the other hand, unless the revolution number Ne is lower than the predetermined revolution number N4, the inhibition flag continues the set status in spite of the time-up of the inhibition timer. This set status continues until the revolution number Ne becomes lower than the predetermined value N4 after the time-up, and the power feed to the starter 50 continues to be stopped meantime.

More specifically, the predetermined revolution number N4 is set at the very low revolution number at which the engine can be regarded as being substantially stopped. The reason why the starter drive is inhibited till the lowering of the revolution number N4 below the predetermined revolution number N4 is that, since the setting of the predetermined time T4 is based on the experimental data, the time T4 is corrected to an exact time in a case where it is too short in some states of the engine.

As understood from the above description, according to the engine control apparatus of the embodiment of this invention, the starter switch 52 is turned ON for, at least, the operation delay time T3 of the starter 50. When the starter switch 52 is turned OFF, the inhibition flag is held in the set status for, at least, the predetermined time T4 determined by the engine revolution number on that occasion, since the time of the turn-OFF. During the set period of the inhibition flag, the power feed to the starter 50 is inhibited even if the starter switch 52 is turned ON.

Further, unless the revolution number Ne is lower than the predetermined value N4 at which the engine can be regarded as being substantially stopped, at the time of the lapse of the predetermined time T4, the set status of the inhibition flag is lengthened until the revolution number Ne becomes lower, whereby the power feed to the starter 50 can be exactly inhibited.

Accordingly, in the case where the starter switch 52 is turned ON again on account of the failure of the start of the engine, the restart is allowed in the state where the engine is completely stopped. Therefore, the cylinder discrimination at the time of the restart is facilitated, any erroneous fuel injection and any erroneous ignition are prevented, and the engine can be started reasonably. In turn, the starter pinion 56 is prevented from jumping into the ring gear under the engine rotation, whereby the durability of the starter 50 is also enhanced.

Subsequently, the step 117, et seq. will be described.

Whether or not the drive signal 53 of the starter 50 is in the ON status is detected at the step 117. Subject to the ON status, whether or not the ON time T is greater than the predetermined time T5 is decided at the step 118. The predetermined time T5 is set at a time period greater than the maximum value of a time period for which the driver usually drives the starter 50 for the engine start. Accordingly, the continuation of the ON status in excess of the time T5 is decided as the ON fault of the starter switch 52, and the drive signal 53 of the starter 50 is forcibly set at "OFF" at the next step 123. Besides, an abnormality signal is outputted, and the alarm lamp 61 is lit up to report the fault to the driver.

By the way, in the above description, the continuation time of the "ON" of the starter drive signal 53 is detected in order to detect the abnormal "ON" continuation of the starter switch 52. Of course, however, an abnormality decision can be similarly rendered even when the continuation time of the "ON" of the starter switch 52 is directly detected.

At the next step 119, whether the starter switch 52 is "ON" or "OFF" is detected. If the starter switch 52 is "ON", whether the drive signal 53 of the starter 50 is "ON" or "OFF" is detected at the step 120.

If the drive signal 53 is "OFF", whether or not the continuation time T of the "OFF" is greater than a predetermined time T6 is decided at the next step 124. When the continuation time T becomes greater than the predetermined time T6, the drive signal 53 is forcibly turned OFF at a step 125, and also the alarm lamp 61 is lit up.

Likewise, if the starter switch 52 is "OFF" at the step 119, whether the drive signal 53 of the starter 50 is "ON" or "OFF" is detected at the next step 126. If the drive signal 53 is "ON", whether or not the continuation time T of the "ON" is greater than the predetermined time T6 is decided at the next step 124. When the continuation time T becomes greater than the time T6, the routine proceeds to the step 125.

More specifically, in the case where the restart inhibition decision condition does not hold, the ON/OFF status of the starter switch 52 and the ON/OFF status of the starting-motor drive signal 53 are the same. Therefore, the steps 119, 120 and 124-126 decide the fault of the starter system when a state where one of the statuses is "ON" and where the other is "OFF" has continued in excess of the predetermined time T6.

Owing to the setting of the predetermined time T6 for deciding the fault of the starter system, even when a deviation is involved in both the signals on account of restart inhibition times, the abnormality can be detected without being affected by the deviation.

Incidentally, when the abnormality detection process is incarnated by that circuit separate from the CPU 42 (which may well be another CPU) without resorting to the CPU 42 which executes the starter control program process, the abnormality of the CPU 42 processing the starter control program can be reliably detected by the separate circuit.

As described above, according to the engine control apparatus of the embodiment of this invention, when it is detected that the starter has changed-over from its drive state (starter switch "ON") into its non-drive state (starter switch "OFF"), the time period in which the engine (crank) is completely stopped is predicted on the basis of the engine revolution speed at that time, and the predetermined period T4 corresponding to the revolution speed is set as the restart inhibition period. Therefore, the engine can be restarted from the state where it has stopped, and it is possible to prevent that worsening of the restartability which occurs at the time of the restart during the engine rotation immediately before the engine stop, and in which the cycles of the crankangle sensor signals become the unequal intervals, so the engine control unit cannot properly perform the cylinder discrimination and fails to perform the ignition timing control and fuel injection control for the appropriate cylinders. Moreover, the restart inhibition time is shortened to the utmost, whereby the engine can be started reasonably and reliably without inflicting the uneasy feeling on the driver, to bring forth the advantage that the restartability is enhanced.

Besides, in the case where the revolution speed at the time of the lapse of the predetermined time (restart inhibition period) T4 is not lower than the predetermined value N4, the period of the restart inhibition is further lengthened, whereby the error of the prediction time can be corrected, and the restart of the starter can be precisely inhibited for the period till the stop of the engine.

Besides, in the case where the starter switch has turned ON during the engine running after the completion of the engine start, owing to the decision of the running mode, the drive of the starting motor relay is inhibited, and the running of the starting motor is inhibited. Therefore, the damage of the starter pinion attributed to the jump of the starter pinion into the ring gear being rotating is prevented, and the durability of the starter can be enhanced.

Further, in the case where the ON status of the starter switch has continued in excess of the predetermined time T5, or in the case where the state in which the ON or OFF statuses of the starter switch and the starting-motor drive signal disagree has continued in excess of the predetermined time T6, the drive of the starting motor relay is inhibited, and the running of the starting motor is stopped, whereby the heat generation of the starter motor is suppressed, and the durability of the starter can be enhanced.

Still further, the ECU includes the cylinder discrimination process portion which discriminates the individual cylinders on the basis of the signals of the crankangle sensor and cam sensor, the cylinder learning control portion which learns the cylinder sequence discriminated by the cylinder discrimination process portion, so as to discriminate the individual cylinders on the basis of the learnt cylinder sequence, and the means for clearing the learning when the engine rotation is slower than the predetermined revolution speed at which the engine is substantially stopped, whereby even in the apparatus which performs the cylinder discrimination by the learning, the learning can be reliably cleared at the time of the restart, and the restart is initiated from the engine stop state, so that any erroneous cylinder discrimination can be prevented from occurring due to the cylinder discrimination based on the learning at the time of the restart.

Various modifications and alterations of this invention will be apparent to those skilled in the art without departing from the scope and spirit of this invention, and it should be understood that this invention is not limited to the illustrative embodiments set forth herein.

What is claimed is:

1. An engine control apparatus comprising a starter switch which is turned ON in starting an engine, a starting motor which has a pinion meshing with a ring gear of the engine and which is driven in starting the engine, a crankangle sensor which outputs a crankangle signal every predetermined rotational angle of a crankshaft, a cam sensor which outputs a signal in a predetermined pattern for performing a cylinder discrimination in correspondence with rotation of a camshaft that rotates at a predetermined rate to rotation of the crankshaft, and an engine control unit which has a function of performing an ignition control and a fuel control of the engine on the basis of, at least, the output signals of said crankangle sensor and said cam sensor, and a function of driving and controlling said starting motor on the basis of an input signal of said starter switch, wherein said engine control unit includes restart inhibition means for inhibiting power feed to said starting motor for a predetermined time period since change of said starter switch from "ON" to "OFF", even when said starter switch turns ON again, and means for altering the predetermined time period in correspondence with a revolution speed of the engine at the change of said starter switch from the "ON" to the "OFF".

2. An engine control apparatus as defined in claim 1, wherein said engine control unit includes lengthening means for further lengthening the inhibition time period of the power feed to said starting motor when the engine revolution speed does not lower to a predetermined value upon lapse of the predetermined time period.

3. An engine control apparatus as defined in claim 2, wherein said lengthening means inhibits the power feed to said starting motor until the engine revolution speed lowers to the predetermined value.

4. An engine control apparatus as defined in claim 1, wherein said engine control unit includes means for inhibiting the power feed to said starting motor, in a case where said starter switch has turned ON during engine rotation after completion of the start of the engine.

5. An engine control apparatus as defined in claim 1, wherein said engine control unit includes means for inhibiting the power feed to said starting motor, in a case where an ON status of said starter switch has continued for a predetermined time period, or in a case where ON or OFF statuses of said starter switch and a starting-motor drive signal which becomes ON during a period during which the power feed inhibition is released within the ON period of said starter switch disagree for a predetermined time period.

6. An engine control apparatus as defined in claim 1, wherein said engine control unit includes a cylinder discrimination process portion which discriminates individual cylinders on the basis of the signals of said crankangle sensor and said cam sensor, a cylinder learning control portion which learns a cylinder sequence discriminated by said cylinder discrimination process portion and which discriminates the individual cylinders on the basis of the learnt cylinder sequence, and means for clearing the learning when the engine revolution speed is lower than a predetermined revolution speed at which engine rotation is substantially stopped.

* * * * *